US008911038B2

(12) United States Patent
Gmeiner

(10) Patent No.: US 8,911,038 B2
(45) Date of Patent: Dec. 16, 2014

(54) DEVICE FOR ATTACHING A FUNCTIONAL PART TO A RAIL OF A DRAWER PULL-OUT GUIDE

(71) Applicant: Julius Blum GmbH, Hochst (AT)

(72) Inventor: Christoph Gmeiner, Lustenau (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/898,866

(22) Filed: May 21, 2013

(65) Prior Publication Data

US 2013/0257245 A1 Oct. 3, 2013

Related U.S. Application Data

(63) Continuation of application No. PCT/AT2011/000410, filed on Oct. 4, 2011.

(30) Foreign Application Priority Data

Nov. 23, 2010 (AT) ..... A 1941/2010

(51) Int. Cl.
*A47B 88/04* (2006.01)
*A47B 88/12* (2006.01)

(52) U.S. Cl.
CPC ..... *A47B 88/047* (2013.01); *A47B 88/0477* (2013.01); *A47B 88/12* (2013.01); *A47B 88/0481* (2013.01); *A47B 2210/0078* (2013.01)
USPC ..... 312/331

(58) Field of Classification Search
USPC ..... 312/330.1, 331, 334.1, 334.7, 334.8, 312/319.1; 384/18, 19, 22
See application file for complete search history.

(56) References Cited

U.S. PATENT DOCUMENTS

| | | | | |
|---|---|---|---|---|
| 5,135,294 | A * | 8/1992 | Ohshima et al. | 312/319.1 |
| 5,492,400 | A * | 2/1996 | Rock | 312/331 |
| 5,564,807 | A * | 10/1996 | Rock et al. | 312/331 |
| 6,231,143 | B1 * | 5/2001 | Stijns | 312/331 |
| 6,666,306 | B2 * | 12/2003 | Gasser | 188/82.1 |

(Continued)

FOREIGN PATENT DOCUMENTS

| | | |
|---|---|---|
| CN | 201205097 | 3/2009 |
| CN | 101810404 | 8/2010 |

(Continued)

OTHER PUBLICATIONS

International Search Report (ISR) issued Nov. 22, 2011 in International (PCT) Application No. PCT/AT2011/000410.

(Continued)

*Primary Examiner* — James O Hansen
(74) *Attorney, Agent, or Firm* — Wenderoth, Lind & Ponack, L.L.P.

(57) ABSTRACT

A device (20) for attaching a functional part (14) to a rail (5,6) of a drawer pull-out guide (3) includes a first bearing element (11) and at least one second bearing element (12), wherein the bearing elements (11, 12) are arranged in the front end area of the rail (5) and in the rear end area of the rail (5), wherein at least one clamping device (13) is provided, by means of which the at least two bearing elements (11, 12), in the installed position thereof on the rail (5), can be connected to each other and braced relative to each other.

12 Claims, 6 Drawing Sheets

(56) References Cited

U.S. PATENT DOCUMENTS

| | | | | |
|---|---|---|---|---|
| 7,077,488 | B2 | 7/2006 | Wiklund et al. | |
| 7,602,135 | B2 | 10/2009 | Huber et al. | |
| 8,210,623 | B2 * | 7/2012 | Chen et al. | 312/331 |
| 2011/0200278 | A1 | 8/2011 | Radusin | |

FOREIGN PATENT DOCUMENTS

| | | |
|---|---|---|
| CN | 101862080 | 10/2010 |
| DE | 202 04 724 | 7/2002 |
| DE | 20 2008 008 121 | 12/2009 |
| DE | 20 2008 012 996 | 3/2010 |
| EP | 0 635 226 | 1/1995 |
| EP | 1 374 732 | 1/2004 |
| EP | 2 168 455 | 3/2010 |
| EP | 2 208 439 | 7/2010 |

OTHER PUBLICATIONS

Austrian Patent Office Search Report (ASR) completed Jun. 7, 2011 in Austrian Patent Application No. A 1941/2010.

Chinese Search Report issued in corresponding Chinese Patent Application No. 201180057109.3.

* cited by examiner

DEVICE FOR ATTACHING A FUNCTIONAL PART TO A RAIL OF A DRAWER PULL-OUT GUIDE

The present invention concerns a device for attaching a functional part to a rail of a drawer extension guide comprising a first mounting element and at least one second mounting element, wherein the mounting elements are to be arranged on the one hand in the front end region of the rail and on the other hand in the rear end region of the rail.

The invention further concerns a drawer extension guide, wherein a functional part—in particular a toothed rack, a pull-in device for drawers, a touch-latch device and/or a damping device for damping a rail movement—is fixed by way of a device of the kind to be described to a rail of the drawer extension guide.

The fitment of functional parts to a drawer extension guide is described for example in DE 20 2008 012 996 U1. In that document the functional parts are in the form of end stops arranged at the front and rear end regions of the runner rail, in particular also in force-locking relationship. In that case the functional parts can be adapted inter alia for coupling or securing the drawer, as end abutments and as locking means for the closed position. The end stops to be arranged at the two end regions of the runner rail can be released from the rail in particular when a high force is acting, in particular when a force for rail movement is transmitted to the extension guide by way of the functional parts.

The mounting of functional parts to a drawer extension guide is also described in U.S. Pat. No. 7,077,488 B2, DE 20 2008 008 121 U1, EP 2 168 455 A1 and DE 202 04 724 U1. These structures also involve the serious risk that the functional parts can be easily detached from the rail of the drawer extension guide when a force is acting thereon.

It is therefore an object of the present invention to propose a device of the general kind set forth in the opening part of this specification, wherein a functional part of the drawer extension guide can be fixed to a rail of the drawer extension guide in a quick, convenient and reliable fashion.

That object is achieved by the features according to a first aspect of the invention. Further advantageous configurations of the invention are recited in the appendant claims.

According to the invention, at least one tensioning device is provided by which the at least two mounting elements in their mounted position on the rail can be connected to each other and can be braced relative to each other.

In that way the two mounting elements can firstly be pre-positioned free of forces on the rail of the drawer extension guide, without a force-locking connection causing difficulty with that pre-mounting procedure in that respect. After the two mounting elements have been positioned on the rail they can be connected together by the tensioning device and braced relative to each other in the mounted position. In that way it is possible to implement quick convenient fixing of the mounting elements to the rail, wherein the mounting elements are also adequately safeguarded against unwanted release from the rail.

In an embodiment it can be provided that the tensioning device has at least one clamping band—preferably comprising a flexible plastic material—by which the two mounting elements can be connected together and braced relative to each other. The clamping band can be in the form of a latching band—in particular in the form of a cable tie—, wherein the two mounting elements in the mounted position thereof on the rail can be lashed fast by the clamping band. By pulling the—preferably self-latching—latching band it can be latched step-wise relative to at least one of the two mounting elements, wherein the two mounting elements can be clampingly fixed to the rails by tightening the clamping band. The mounting elements can also have a positively locking fastening option for connection to the rail. The two mounting elements can therefore be in the form of shaped portions which for pre-positioning purposes can be respectively pushed on to an end of the rail, whereupon after positioning has been effected the mounting elements can be braced relative to each other by the tensioning device.

The mounting elements fixed in that way are suitable in particular for mounting—also for retrofitting—a functional part, for example synchronisation means for synchronising a rail movement of two separate drawer extension guides which in the mounted condition are fixed to a furniture carcass at opposite side walls. In a possible embodiment of the invention it can be provided that the functional part has a toothed rack which is or can be releasably connected to the two mounting elements. For releasably connecting the functional part to at least one of the two mounting parts it is possible to provide a releasable fixing device—in particular a snap connection—.

The functional part is suitable for carrying relatively high forces by virtue of the stable arrangement of the mounting elements relative to the rail. By way of the toothed rack it is for example possible for a movement of a first drawer extension guide to be synchronised with a movement of a second—separate—drawer extension guide. The rail movement of the first drawer extension guide can therefore be synchronised with the rail movement of the second drawer extension guide by way of a gear meshing with the rack and by way of a torsion shaft.

In an embodiment it can be provided that the functional part has an ejection device for ejecting a rail of the drawer extension guide from a closed end position into an open position. Such ejection devices have become known as Touch-Latch devices, wherein ejection of the drawer from a closed end position can be effected by manually applying a pressing and/or a pulling force to the drawer.

Alternatively or additionally it can be provided that the functional part has a pull-in device by which a movable rail of the drawer extension guide can be pulled into the completely closed position towards the end of the closing movement. Such spring-assisted self-retraction devices are already known in many different configurations, wherein the drawer can be pulled into the closed end position by way of a spring-loaded entrainment member.

In addition the functional part can have a damping device, in particular a fluid damper in the form of a rotational damper or in the form of a linear damper, wherein a movement of the drawer over the last closing travel to the completely closed position can be damped by the damping device.

The drawer extension guide according to the invention has a carcass rail to be fixed to a furniture carcass and at least one drawer rail supported movably relative thereto, wherein at least one functional part is connected to the carcass rail or to the drawer rail by way of a device of the kind described.

BRIEF DESCRIPTION OF THE DRAWINGS

Further details and features of the present invention will be described by means of the specific description hereinafter. In the drawings.

DETAILED DESCRIPTION OF THE INVENTION

Figure 1:
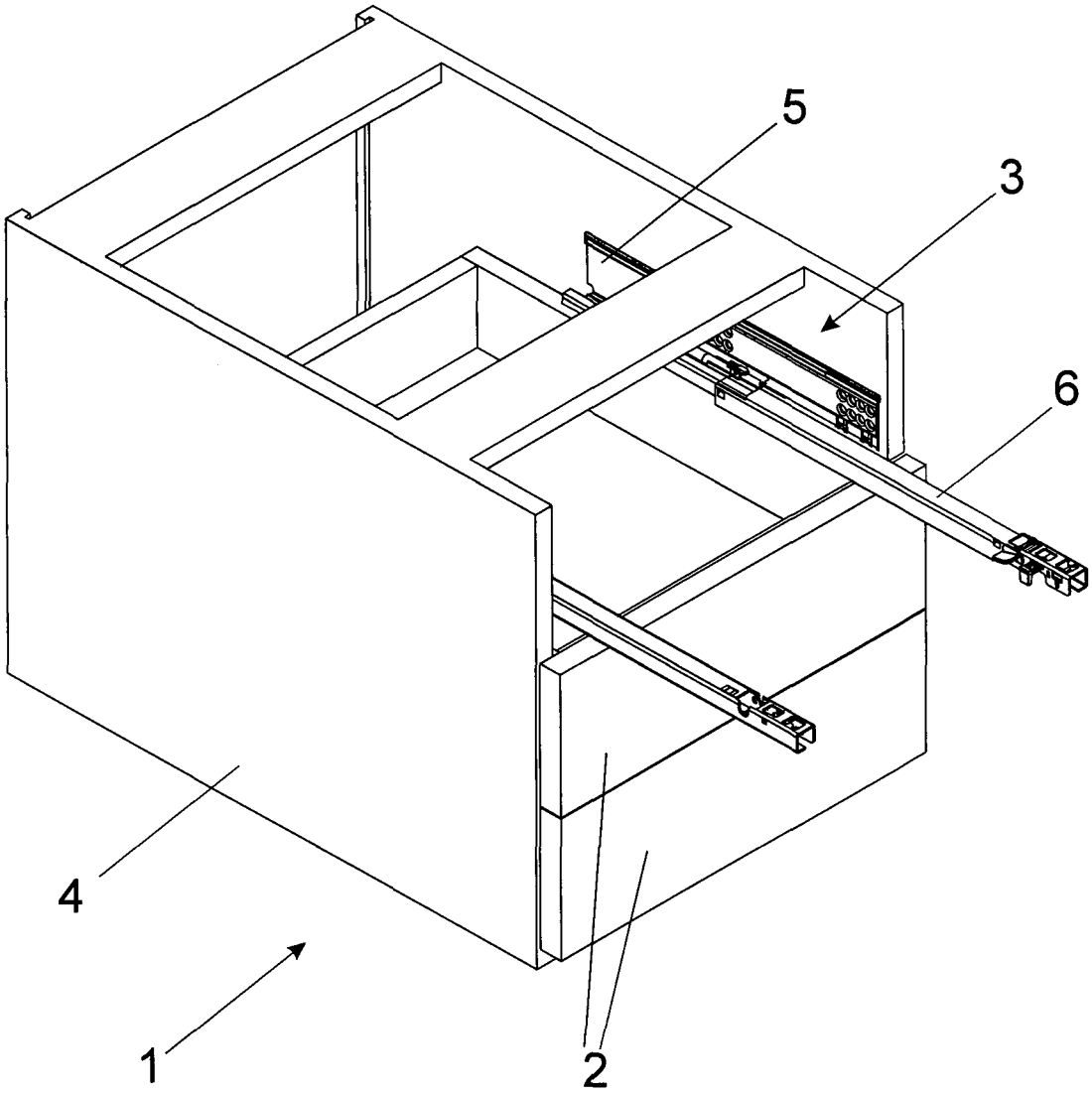
FIG. 1 shows a perspective view of an article of furniture, wherein drawers are supported displaceably relative to a furniture carcass by way of extension guides.

FIG. 1 shows a perspective view of an article of furniture 1, wherein drawers 2 are mounted displaceably relative to a furniture carcass 4 by way of drawer extension guides 3. The drawer extension guide 3 has a carcass rail 5 to be fixed to the furniture carcass 4 and at least one drawer rail 6 which is displaceable relative to the carcass rail 5 and is to be connected to the drawer 2. A displaceably supported central rail can also be optionally arranged between the carcass rail 5 and the drawer rail 6 in order in that way to permit full extension of the drawer 2 relative to the furniture carcass 4.

Figure 2A:
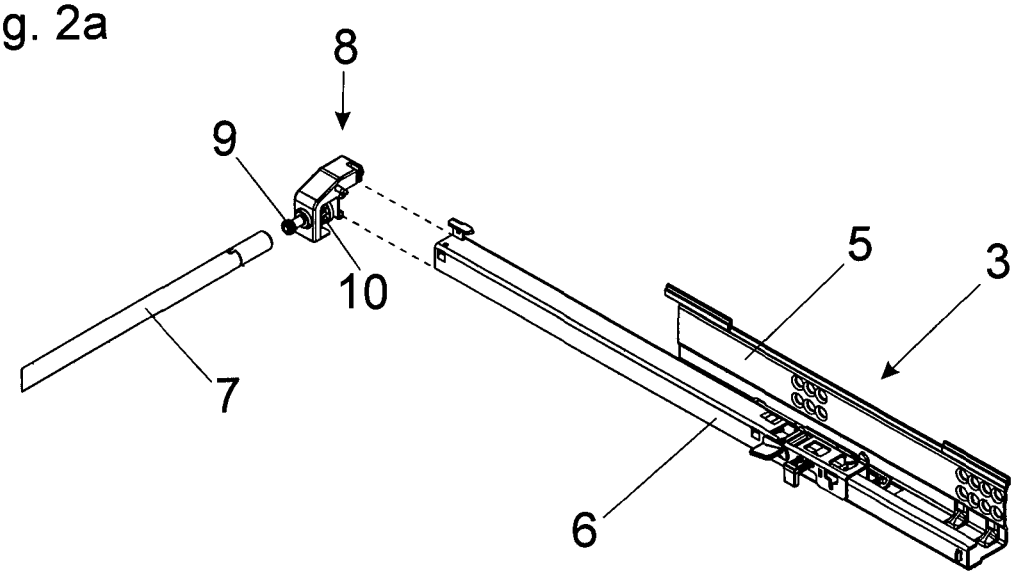
FIGS. 2*a* and 2*b* show a perspective view of an extension guide with a torsion shaft for synchronising a drawer movement and the extension guide as a perspective view from below with a mounting element to be fixed to a rail.

FIG. 2*a* shows a possible area of use of the invention. Provided for synchronisation of a rail movement of the drawer extension guide 3—as is known per se—is a torsion shaft 7 by which a movement of the drawer extension guide 3 can be synchronised with a drawer extension guide which is attached in an opposite relationship on the furniture carcass 4. In the illustrated embodiment, fixed at the rear end region of the drawer rail 6 is a mounting bracket 8 with a rotatably mounted gear 10. The gear 10 on the mounting bracket 8 is motionally coupled to a shaft journal 9 which can be connected to the torsion shaft 7. A movement of the drawer rail 6 can therefore be synchronised in that way with a movement of the drawer rail of the drawer extension guide arranged in opposite relationship on the furniture carcass 4. However, a toothed rack which can be fixed to the carcass rail 5 is required for transmitting a movement between the two drawer extension guides 3. That fixing of the toothed rack is described in greater detail in the Figures hereinafter.

Figure 2B:
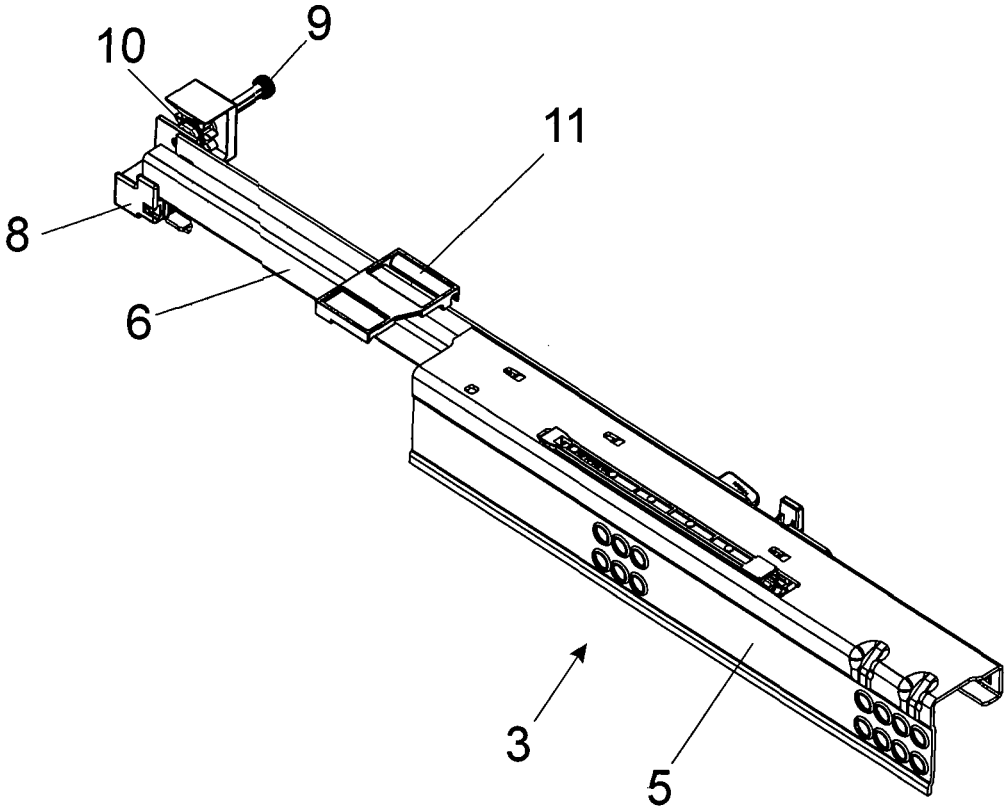

FIG. 2*b* shows a perspective view from below of the extension guide 3, wherein the mounting bracket 8 has already been connected to the rear end of the drawer rail 6. It is possible to see a first mounting element 11 which for prepositioning thereof can be pushed on to the rear end of the carcass rail 5. The mounting element 11 is made in the form of a shaped part from plastic material.

Figure 2C:
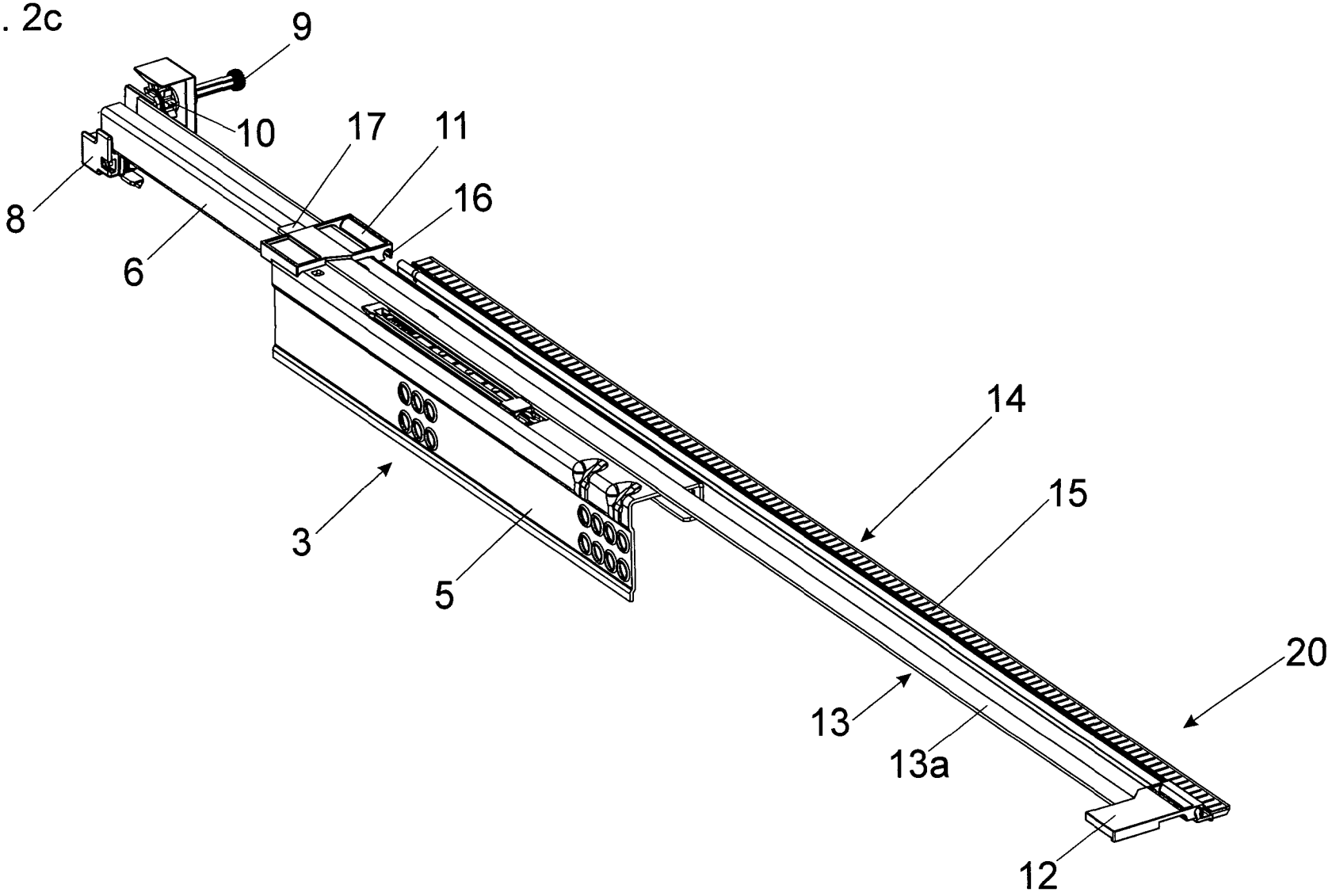
FIG. 2*c* shows a perspective view from below of the extension guide, wherein the second mounting element is to be fastened to a functional part in the form of a toothed rack.

FIG. 2*c* shows a perspective view from below of the extension guide 3, wherein the device 20 (an attachment device) for mounting the functional part 14 can be seen here. Besides the mounting element 11 which has already been pushed on at the rearward end of the carcass rail 5, the device 20 includes a second mounting element 12 which can be pushed onto the front end of the carcass rail 5 and which is or can be connected to the tensioning device 13 in the form of an elongate clamping band 13*a*. The clamping band 13*a* can be in the form of a self-latching latching band—in particular in the form of a cable tie—and is passed through the first mounting element 11, wherein the clamping band 13*a* can be latched to the mounting element 11 at intervals when being pulled through. A functional part 14 in the form of a toothed rack 15 is connected to the second mounting element 12 or can be releasably connected thereto by way of a fixing device (not shown here). The toothed rack 15 can be passed through a guide 16 arranged on the first mounting element 11, in which case the two mounting elements 11, 12 can be braced together in their mounted position on the carcass rail 5 by manually pulling on the free end 17 of the clamping band 13*a* so that the toothed rack 15 can also be fixed relative to the two mounting elements 11, 12.

Figure 2D:
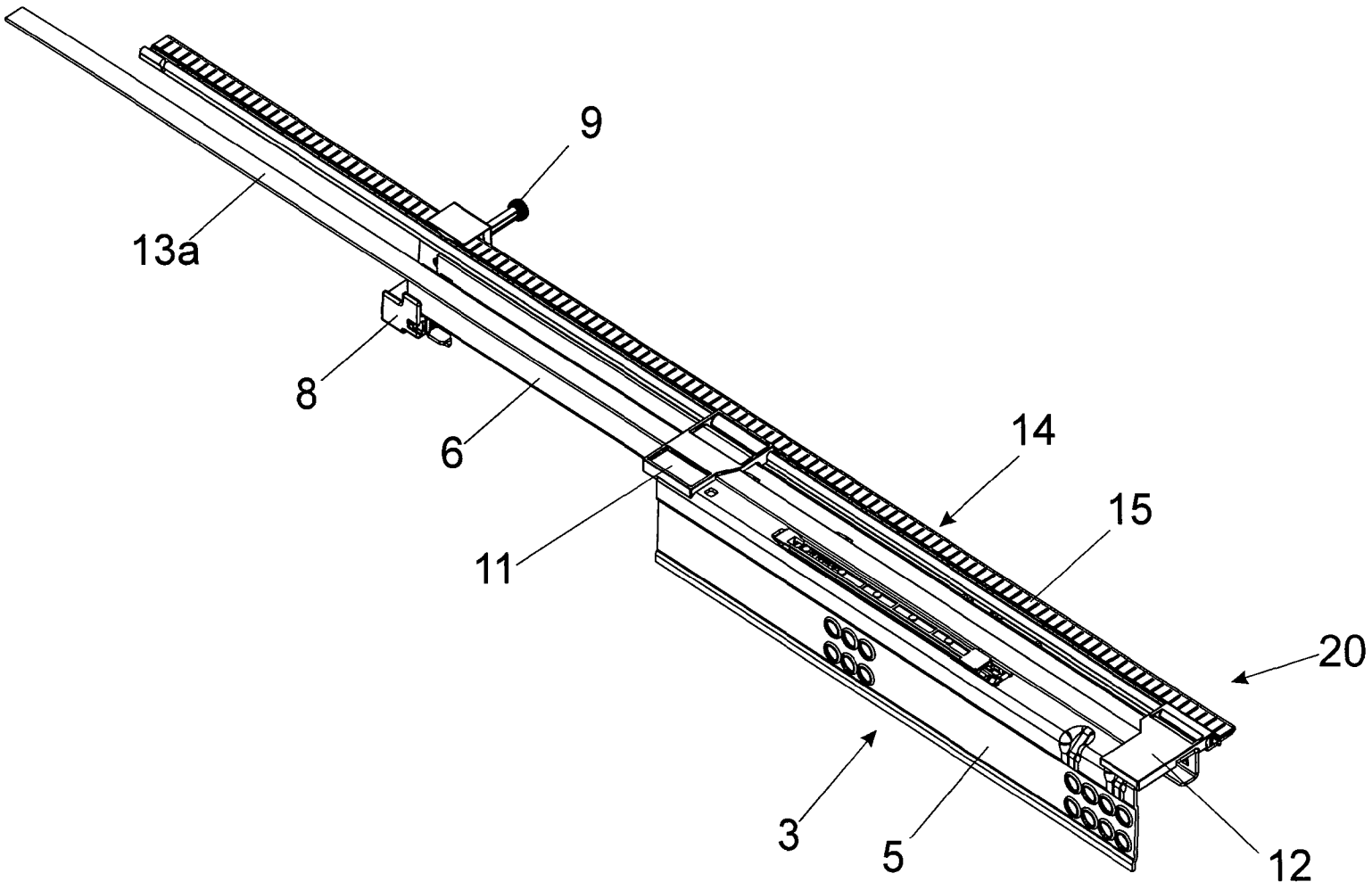
FIG. 2*d* shows a perspective view from below of the extension guide, wherein the two mounting elements are fixed relative to the rail.

FIG. 2*d* shows a perspective view from below of the extension guide 3, wherein the two mounting elements 11, 12 can be braced to each other by tightening the clamping band 13*a* in the mounted position of the mounting elements 11, 12 on the carcass rail 5. After bracing of the two mounting elements 11, 12 has been effected, the clamping band 13*a* projects beyond the mounting element 11. The clamping band 13*a* can be cut to length flush with the mounting element 11 by scissors or a knife. The toothed rack 15 is cut off in a similar fashion so that it terminates substantially flush with the rear side of the mounting bracket 8. In the FIG. 2*d* view the gear 10 of the mounting bracket 8 can run along the subsequently fitted toothed rack 15.

Figure 3:
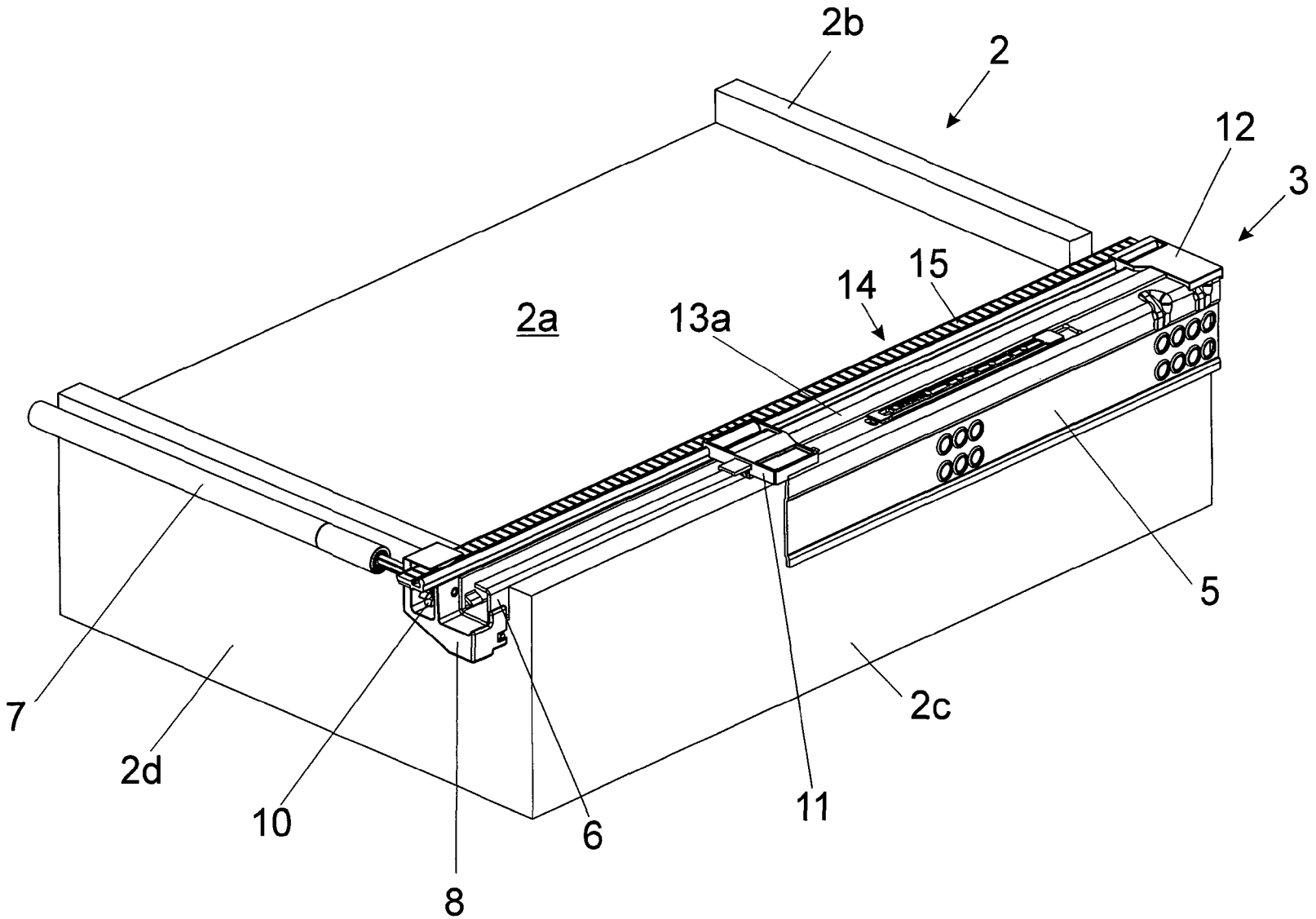
FIG. 3 shows a perspective view from below of a drawer connected to the extension guide.

FIG. 3 shows a perspective view from below of the drawer 2 connected to the extension guide 3. In known manner the drawer 2 has a drawer bottom 2*a*, a front wall 2*b*, side walls 2*c* and a drawer rear wall 2*d*. It is possible to see the mounting elements 11 and 12 which are arranged on the carcass rail 5 and which can be braced relative to each other by pulling on the clamping band 13*a*. The mounting bracket 8 fixed at the rear end of the drawer rail 6 has a gear 10 which can run along the stationary toothed rack 15 upon opening and closing of the drawer 2. The rotary movement of the gear 10 can be synchronised by way of a torsion shaft 7 with the rotary movement of a gear of an opposing drawer extension guide.

Figure 4A:
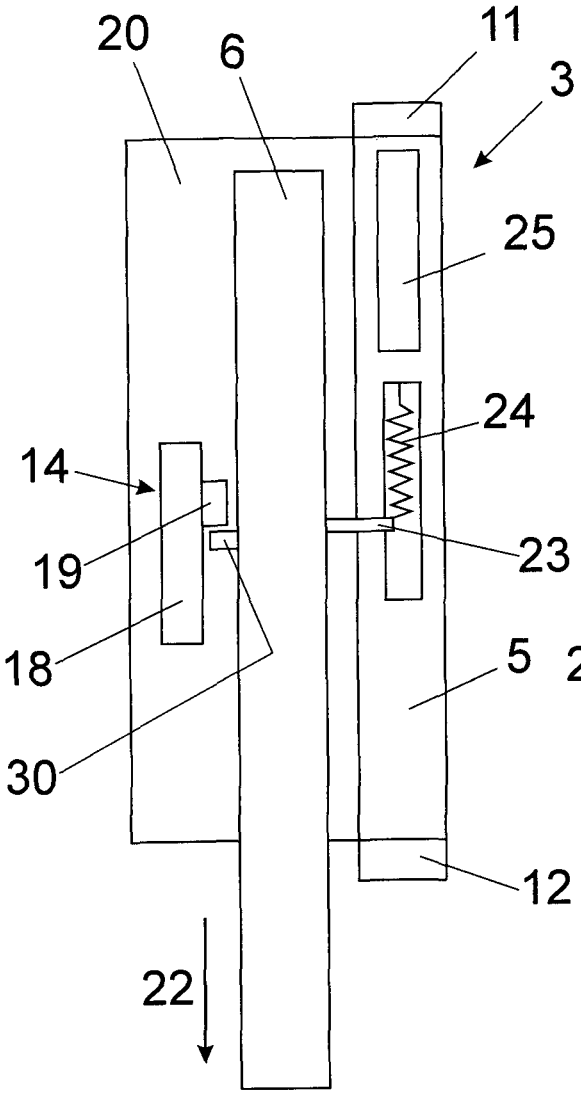
FIGS. 4*a* and 4*b* show highly diagrammatic plan views of the drawer extension guide, wherein the functional part has a Touch-Latch device, a spring-assisted pull-in device and/or a damping device for damping a rail movement.

FIG. 4*a* shows a highly diagrammatic plan view of a drawer extension guide 3 with a carcass rail 5 and at least one drawer rail 6 displaceable relative thereto. The Figure diagrammatically shows the device 20 for mounting a functional part 14, the device 20 being fixed to the carcass rail 5 by way of the two mounting elements 11, 12 spaced from each other in the longitudinal direction of the rail. In the illustrated embodiment the functional part 14 has an ejection device 18 (in particular a Touch-Latch device), by which the at least one drawer rail 6 is movable from a closed end position into an open position. The ejection device 18 includes a pushing engagement element 19 which co-operates with the drawer rail 6 or with an abutment 30 arranged on the drawer rail 6, upon opening of the drawer rail 6. The ejection device 18 is triggered by manually pulling and/or pushing on the drawer 2, whereupon the drawer rail 6 is movable from a closed end position in the ejection direction (direction of the arrow 22) into an open position by way of the pushing engagement element 19 acting on the abutment 30. In addition there is provided a spring-assisted pull-in device 24 by which the drawer rail 6 can be pulled into the completely closed position towards the end of the closing movement by way of a coupling element 23. That pull-in movement to the completely closed position can be damped by a damping device 25 (for example a piston-cylinder unit).

Figure 4B:
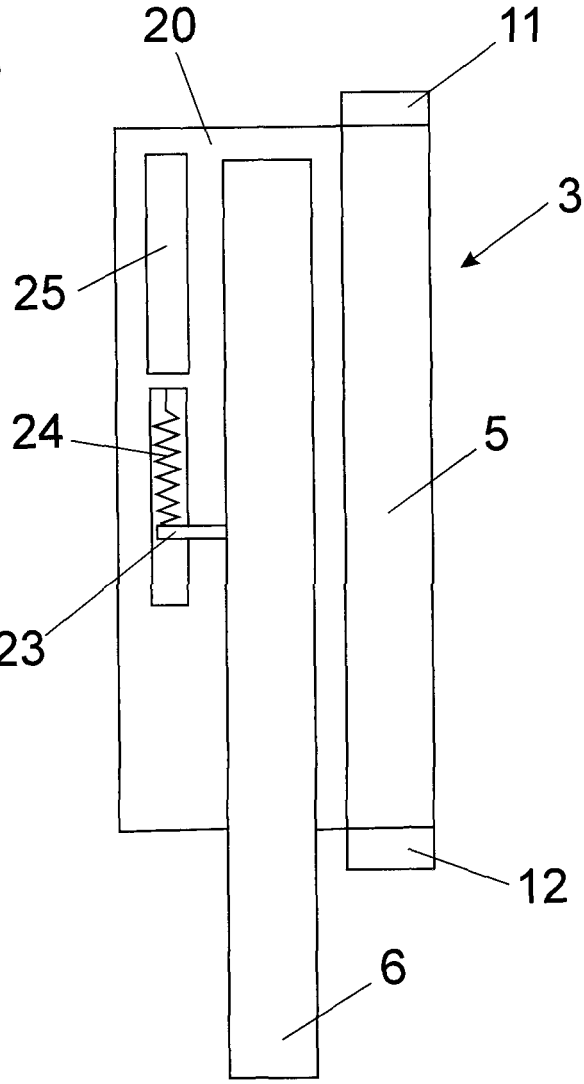

FIG. 4*b* also shows a highly diagrammatic plan view of the extension guide 3, with the carcass rail 5 and at least one drawer rail 6 displaceable relative thereto. As shown in FIG. 4*b* the functional part 14 has a spring-assisted pull-in device 24 and a damping device 25—in particular a fluid damper—for damping that spring-assisted pull-in movement. In the illustrated embodiment both the pull-in device 24 and also the damping device 25 are fixed to the carcass rail 5 by way of the device 20 with the two mounting elements 11, 12. Towards the end of the closing movement of the drawer rail 6 the coupling element 23 is coupled to the pull-in device 24, whereupon the drawer rail 6 can be pulled into the closed position, wherein that pulling-in movement can be damped by the damping device 25.

The invention is not limited to the illustrated embodiments but includes or extends to all technical variants which can fall within the scope of the following claims. The positional references adopted in the description such as for example up, down, lateral and so forth are also related to the directly described and illustrated Figure and are to be appropriately transferred to the new position upon a change in position. In the illustrated embodiments it is mounting of the functional part 14 to the carcass rail 5 that is respectively shown, but it will be appreciated that it is also possible for the functional part or parts 14 to be fixed by way of the described device 20 to the drawer rail 6 and/or to a central rail of the drawer extension guide 3.

The invention claimed is:

1. A drawer extension guide comprising:

a carcass rail to be fixed to a furniture carcass;

a drawer rail mounted displaceably relative to the carcass rail;

an attachment device; and a functional part connected to the carcass rail or the drawer rail by the attachment device, wherein the attachment device includes a first mounting element and a second mounting element, the first and second mounting elements being pre-positioned on a front end region and a rear end region, respectively, of the carcass rail or the drawer rail in a length direction thereof, and a tensioning device by which the first and second mounting elements pre-positioned on the carcass rail or the drawer rail are connected to each other and are tensioned relative to each other in the length direction of the carcass rail or the drawer rail so as to be clampingly fixed to the carcass rail or the drawer rail.

2. The drawer extension guide according to claim 1, wherein the tensioning device has a clamping band.

3. The drawer extension guide according to claim 2, wherein the clamping band is in the form of a latching band which is latchable to at least one of the first and second mounting elements.

4. The drawer extension guide according to claim 2, wherein the clamping band is in the form of a self-latching band which is latchable to at least one of the first and second mounting elements.

5. The drawer extension guide according to claim 1, wherein the first and second mounting elements can be pushed onto respective ends of the carcass rail or the drawer rail.

6. The drawer extension guide according to claim 1, wherein the attachment device is made from a plastic material.

7. The drawer extension guide according to claim 1, wherein the functional part is or can be releasably connected to at least one of the first and second mounting elements of the attachment device.

8. The drawer extension guide according to claim 1, wherein a movement of the drawer rail of the drawer extension guide can be determined by the functional part.

9. The drawer extension guide according to claim 1, wherein the functional part has a toothed rack.

10. The drawer extension guide according to claim 1, wherein the functional part has an ejection device for ejecting the drawer rail from a closed end position into an open position.

11. The drawer extension guide according to claim 1, wherein the functional part has a pull-in device, by which the drawer rail can be pulled into a completely closed position towards an end of a closing movement.

12. The drawer extension guide according to claim 1, wherein the functional part has a damping device for damping a movement of the drawer rail.

* * * * *